US007591212B2

(12) United States Patent
Myers, Jr. et al.

(10) Patent No.: US 7,591,212 B2
(45) Date of Patent: Sep. 22, 2009

(54) CONNECTOR FOR PERFORATING GUN TANDEM

(75) Inventors: William D. Myers, Jr., Houston, TX (US); Edgar W. Van Sickle, Houston, TX (US); Kristian Vargervik, Stavanger (NO)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 12/039,353

(22) Filed: Feb. 28, 2008

(65) Prior Publication Data

US 2008/0210425 A1 Sep. 4, 2008

Related U.S. Application Data

(62) Division of application No. 10/888,413, filed on Jul. 9, 2004, now Pat. No. 7,360,487.

(60) Provisional application No. 60/486,101, filed on Jul. 10, 2003.

(51) Int. Cl.
*E21B 43/12* (2006.01)
*E21B 43/1185* (2006.01)

(52) U.S. Cl. ..... 89/1.15; 175/4.54

(58) Field of Classification Search ..... 89/1.15, 89/1.151; 175/4.54
See application file for complete search history.

(56) References Cited

U.S. PATENT DOCUMENTS 2,264,450 A 2/1941 Mounce
2,257,271 A * 9/1941 McCullough ..... 175/4.56
2,742,856 A 4/1956 Fieser et al.
3,173,992 A 3/1965 Boop
3,320,884 A 5/1967 Kowalick et al.
3,446,284 A * 5/1969 Dyer et al. ..... 173/164
4,266,613 A 5/1981 Boop
4,345,646 A 8/1982 Terrell
4,576,233 A 3/1986 George
4,850,438 A 7/1989 Regalbuto
5,216,197 A 6/1993 Huber et al.
5,366,013 A 11/1994 Edwards et al.
5,551,520 A 9/1996 Bethel et al.
5,571,986 A 11/1996 Snider et al.
5,803,175 A 9/1998 Myers, Jr. et al.
5,992,523 A * 11/1999 Burleson et al. ..... 166/297
6,295,912 B1 10/2001 Burleson et al.
6,675,896 B2 1/2004 George
7,013,977 B2 * 3/2006 Nordaas ..... 166/297

FOREIGN PATENT DOCUMENTS

EP 0030498 B1 5/1985
EP 0728913 A2 8/1996

* cited by examiner

*Primary Examiner*—Stephen M Johnson
(74) *Attorney, Agent, or Firm*—Bracewell & Giuliani LLP

(57) ABSTRACT

A perforating gun connector comprising a first and second section connected together on one end. The two sections of the perforating gun connector that couple together are correspondingly tapered so that one end of one connector is tapered and fits into the corresponding tapered hollowed section of one end of the other section. The present invention also provides for the inclusion of shaped charges and booster charges within. Adjacent the charges are sealing bulkheads.

2 Claims, 1 Drawing Sheet

CONNECTOR FOR PERFORATING GUN TANDEM

RELATED APPLICATIONS

This application claims priority from co-pending U.S. Provisional Application No. 60/486,101, filed Jul. 10, 2003, the full disclosure of which is hereby incorporated by reference herein.

BACKGROUND OF THE INVENTION

1. Field of the Invention

The invention relates generally to the field of oil and gas production. More specifically, the present invention relates to an apparatus that connects perforating guns. Yet more specifically, the present invention relates to a perforating gun connector utilizing corresponding tapered ends to facilitate connections thereof. Yet even more specifically, the present invention relates to an automated method of connecting perforating guns with a perforating gun connector.

2. Description of Related Art

Perforating guns are used for the purpose, among others, of making hydraulic communication passages, called perforations, in wellbores drilled through earth formations so that predetermined zones of the earth formations can be hydraulically connected to the wellbore. Perforations are needed because wellbores are typically completed by coaxially inserting a pipe or casing into the wellbore, and the casing is retained in the wellbore by pumping cement into the annular space between the wellbore and the casing. The cemented casing is provided in the wellbore for the specific purpose of hydraulically isolating from each other the various earth formations penetrated by the wellbore.

Included with the perforating guns are shaped charges that typically include a housing, a liner, and a quantity of high explosive inserted between the liner and the housing. When the high explosive is detonated, the force of the detonation collapses the liner and ejects it from one end of the charge at very high velocity in a pattern called a "jet". The jet penetrates the casing, the cement and a quantity of the formation.

Often more than one perforating gun is required to perforate a wellbore. In these instances multiple perforating guns are inserted into a wellbore and connected end to end with a perforating gun connector. Generally the perforating gun connectors are made from two sections, where one section is secured to one perforating gun, the other section secured to another perforating gun, and the two connector sections are then joined. Thus each section has two ends, where one end is formed for connection to a perforating gun, and the other end is formed for connection to the other section.

Within each connector is a length of detonating cord that transmits a detonation wave that is ultimately transferred to the shaped charges. Since the perforating gun connection is made up of two separate sections, a first booster charge is disposed in one of the sections and a second booster charge is disposed in the adjacent section. Thus the detonation energy is transferred from one section to its adjacent section by when the first booster charge detonates it transfers an explosive shock wave across the air gap thereby igniting the second booster charge. Ignition of the second booster charge in turn transfers the detonation wave to its attached detonation cord.

Generally, both ends of the sections are threaded for connecting to the perforating gun and to the other section, thus connection to the perforating gun and to the other section is accomplished by screwing the section onto the perforating gun and other section. Typically, after the sections of the connectors are attached to the perforating guns, the perforating gun of one of the sections is inserted into the wellbore and secured such that the section is pointing up out of the wellbore. The other section, with its attached perforating gun, is hoisted above the secured section and positioned so that the hoisted section is coaxial with the secured section. The hoisted section is then lowered onto the secured section and the hoisted perforating gun and hoisted section are axially rotated in order to screw the hoisted section onto the secured section.

One of the problems with this technique is that current connection devices require a manual attendant to be present at the site where the perforating gun connector sections are being joined. Attendants are required to guide the hoisted section cleanly into the secured section to ensure the sections are substantially coaxially aligned and to prevent cross threading. Further, in situations where the first and second booster charges within the connectors are exposed, attendants are needed to prevent the sections from impacting one another in a manner that could prematurely detonate the explosives within the connectors. Also, these attendants must inspect the sections of the connectors to check that the first and second booster charges are properly in place before being inserted into the wellbore.

This currently known operation of connecting perforating guns however is hazardous to attendant personnel who actually perform the connecting. Because of the mass of the perforating guns and their respective connectors, the attendant personnel must remain vigilant to avoid becoming pinned between the hoisted section and the secured section. Further, the presence of the high explosives within the connectors and the perforating guns require extra care. While these handling considerations could be greatly reduced if the connection procedure were automated, all other known connection means on the perforating gun connection sections are incapable of being reliably connected by mechanical means, such as with a pipe-handling device. For example, prior art perforating gun connectors that are coupled with a pipe-handling device are prone to become cross-threaded. Further the controllability of mechanical coupling devices make it difficult to accurately insert a hoisted section into a secured section, which can not only lead to the cross threading problem, but can also result in possible damage to the explosives within the connectors.

Therefore, there exists a need for an apparatus and a method to connect perforating guns that increases the reliability of connecting perforating guns, substantially reduces the handling problems associated with coupling perforating guns, and provides for an automated method of reliably connecting perforating guns.

BRIEF SUMMARY OF THE INVENTION

The present invention involves a perforating gun connector comprising, a first section having top end and a bottom end, with a connector is provided on the top end. The second section has an upper end and a lower end, also with a connector is provided on its lower end. The bottom end of the first section is formed for cooperative engagement with the upper end of the second section. Also include is an upper bulkhead disposed on the bottom end of the first section. The upper bulkhead provides a fluid tight seal at the bottom end of the first section. Also provided is a lower bulkhead disposed on the upper end of the second section, where the bulkhead provides a fluid tight seal at the upper end of the second section.

3. The perforating gun connector of the present invention further includes a cavity formed by engaging the bottom end of the first section with the upper end of the second section. The cavity is disposed between the bottom end of the first section and the upper end of the second section. Also included with the present invention is at least one vent hole providing communication between the cavity and the outer surface of the upper end of the second section. The present invention further comprises a series of threads disposed on the outer surface of the bottom end of the first section. A hollowed out section is formed on the upper end of the second section. A series of threads is disposed on the hollowed out section. These threads are formed to cooperatively mate with the series of threads disposed on the outer surface of the bottom end of the first section. Alternatively, the threads considered on the hollowed out section and on the bottom end of the first section can be API threads. A further advantage of the present invention is realized by tapering the bottom end of the first section and the hollowed out section. Each section is correspondingly tapered for sealing engagement with the other section.

The perforating gun connector of the present invention further comprises an upper passage formed within the first section. The axis of the upper passage is substantially parallel with the axis of the first section. One end of the upper passage terminates at the upper bulkhead. The perforating gun connector of the present invention further comprises a lower passage formed within the second section. The axis of the lower passage is substantially parallel with the axis of the second section, and one end of said lower passage terminates at the lower bulkhead. The perforating gun connector of the present invention further comprises a first booster charge disposed in said upper passage proximate to said upper bulkhead and a second booster charge disposed in the lower passage proximate to the lower bulkhead.

The present invention considers a method of connecting at least two perforating guns with a perforating gun connector. The perforating gun connector comprises a first section having a top end, a bottom end, and a connector provided on its top end. The perforating gun connector further includes a second section having an upper end, a lower end, and a connector provided on the lower end. Wherein the bottom end of the first section is formed for cooperative engagement with the upper end of the second section. The method comprises connecting the top end of the first section to a first perforating gun, then connecting the bottom end of the second section to a second perforating gun. The method of the present invention can also include placing the top end that is connected to the first perforating gun into a pipe handling device and placing the bottom end that is connected to the second perforating gun in a pipe handling device, then operating the pipe handling device to engage said bottom end of the first section to the upper end of the second section, thereby securing the first perforating gun to the second perforating gun. The method of the present invention considers operating the pipe handling device in an automated fashion.

The method of the present invention further considers a perforating gun connection comprising a series of threads disposed on the outer surface of the bottom end of the first section, a hollowed out section formed on the upper end of the second section, and a series of threads disposed on the hollowed out section. The series of threads formed on the upper end of the second section are formed to cooperatively mate with the series of threads disposed on the outer surface of said bottom end of said first section. The method of the present invention further comprises rotating the first section about its axis with respect to the second section while contacting the bottom end of the first section with the hollowed out section on the second section thereby causing the series of threads disposed on the bottom end of the first section to engage the threads formed on the hollowed out section of the second section. The method of the present invention comprises the bottom end of the first section being tapered and the hollowed out section being correspondingly tapered to facilitate automated engagement with the tapered bottom end.

DETAILED DESCRIPTION OF THE INVENTION

Figure 1:
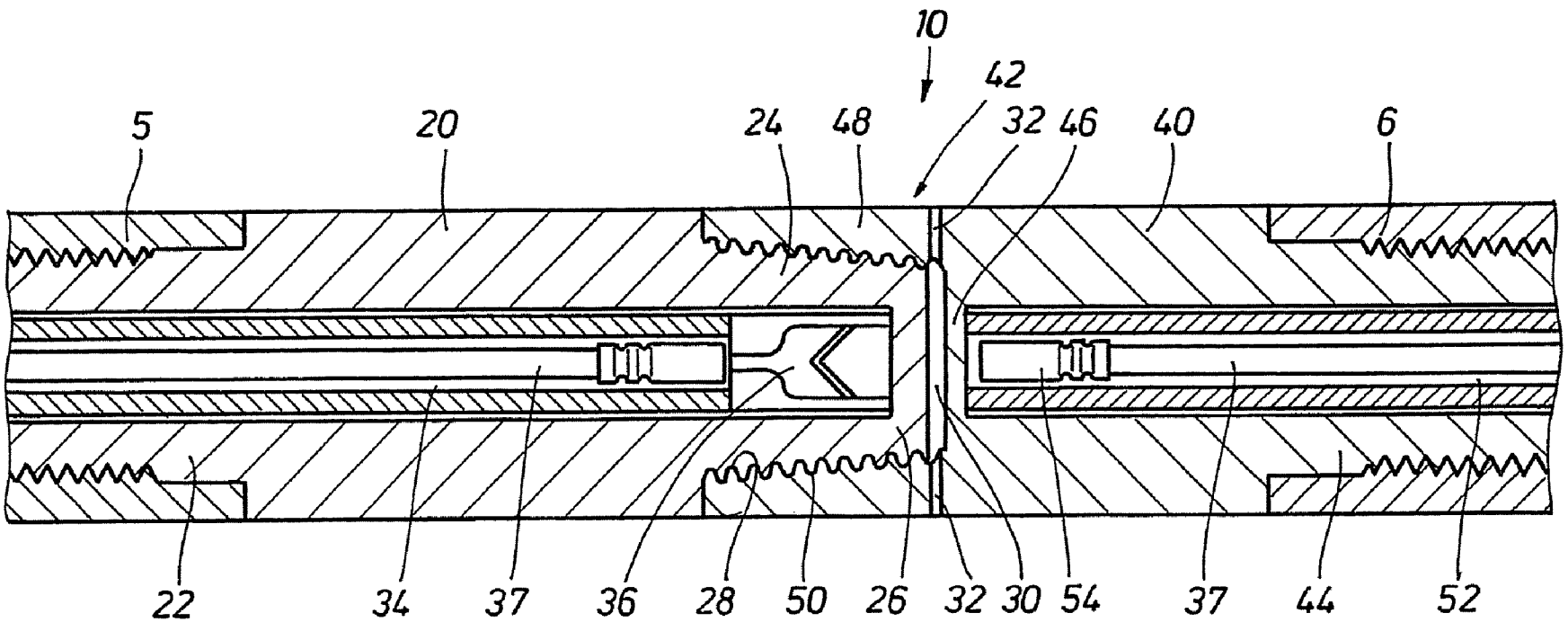
FIG. 1 depicts a cross sectional view of one embodiment of the present invention.

With reference to the drawings herein, a cross sectional view of one embodiment of a perforating gun connector 10 of the present invention is illustrated in FIG. 1. Here, the perforating gun connector 10 comprises a first section 20 and a second section 40 connected together. As shown in FIG. 1, the top end 22 of the first section 20 is threaded to provide a manner of attaching the first section 20 to a first perforating gun 5, where the first perforating gun 5 has corresponding threads formed on its outer radial surface. Many alternatives exist however for attaching the first section 20 to the first perforating gun 5, such as dogs, latch keys, collets, threaded fasteners such as bolts, screws, or lugs, and any other known or later developed attachment device. Likewise, the second section 40 is threaded on its lower end 44 as shown in FIG. 1 for attachment to a second perforating gun 6. Furthermore, the attachment alternatives that exist for the first section 20, exist for the second section 40 as well, that is dogs, latch keys, collets, threaded fasteners such as bolts, screws, or lugs, including any other known or later developed attachment device.

The bottom end 24 of the first section 20 also is adapted for attachment to another member. As shown in FIG. 1, the attachment means are threads 28 formed on the outer circumference of the bottom end 24. Corresponding threads 50 are formed on the second section 40 to cooperatively mate with the threads 28 on the bottom end 24. Preferably, the bottom end 24 of the first section 20 should have a tapered diameter. More specifically, the diameter of the bottom end 24 should decrease the more distal it is from the top end 22. Due to the taper, it is further preferred that the style of the threads 28 on the bottom end 24 be API type threads. However, the threads 28 are not limited to only API threads, but include also, what is referred to in the art as premium tapered thread, home-made tapered threads, or similar tapered threads. It is believed that those skilled in the art can readily produce the proper taper of the bottom end 24 with appropriate threads without undue experimentation.

Provided on the uppermost end of the second section 40 is a hollowed out section 48 formed to cooperatively mate with the bottom end 24 of the first section 20. The hollowed out section 48 is comprised of a cavity having sides, a base, and a top. The top of the hollowed out section 48 is open, and coincides with the axial end of the second section 40 that connects to the first section 20. The base of the hollowed out section 48 is the bottom surface within the hollowed out section 48 that is perpendicular to the axis of the second section 40 and that is most distal from the top of the hollowed out section 48. Connecting the top of the cavity to the base are its sides that define the radial perimeter of the hollowed out section 48. As shown in FIG. 1, the bottom end 24 of the first section 20 resides within the hollowed out section 48 when it is mated with the hollowed out section 48. Since it is intended that the bottom end 24 cooperatively mate or attach to the upper end 42 of the second section 40, the threads 50 within the hollowed out section 48 should be of the same type, pitch, and other dimensions of the threads 28 on the bottom end 24 of the first section 20. Further, the hollowed out section 48 should also be tapered inward to accommodate the taper of the bottom end 24. That is, the diameter of the hollowed out section 48 should increase the more distal it is from the lower end 44 of the second section 40.

Formed coaxially within the body of the first section 20 is an upper passage 34 that travels substantially the length of the first section 20. It is preferred that the upper passage 34 be centered within the first section 20. Disposed within the upper passage 34 is a detonating cord 37 that conducts a detonation wave along its length and transmits it to the first booster charge 36. As is well known, the first booster charge 36 should be within the upper passage 34 where it terminates proximate to the bottom end 24. The diameter of the upper passage 34 should be of sufficient magnitude to easily insert the detonating cord 37 inside the upper passage 34 without snagging the detonating cord 37 or impeding its travel within. The upper passage 34 terminates at an upper bulkhead 26 that separates the upper passage 34 from the outside of the first section 20. Moreover, it is preferred that the upper bulkhead 26 provide a seal between the upper passage 34 and the outside of the first section 20 as long as the upper bulkhead 26 remains intact.

Much like the upper passage 34 of the first section 20, a lower passage 52 is provided in the second section 40 for the installation of a detonating cord 37. Like the upper passage 34, the lower passage 34 should be of sufficient diameter to receive the detonating cord 37 within without snagging, binding, or bending. The lower passage 52 should also be formed substantially at the center of the second section 40 approximately along the length of the second section 40. The lower passage 52 terminates on one end at a lower bulkhead 46 proximate to the upper end 42 of the second section 40. The lower bulkhead 46 should provide a seal between the lower passage 52 and the outside of the second section 40 as long as the lower bulkhead 46 remains intact. A second booster charge 54 is disposed within the lower passage 52 proximate to the lower bulkhead 46.

As the first section 20 and the second section 40 are connected as shown in FIG. 1, the bottom end 24 of the first section 20 does not completely fill the space within the hollowed out section 48. This results in a cavity 30 being formed between the lower most portion of the bottom end 24 and the base of the hollowed out section 48. The resulting cavity 30 resembles a flat cylinder with its outer circumference being bounded by the inner diameter of the base of the hollowed out section 48, and its top and bottom terminating at the bottom most surface of the bottom end 24 and the base of the hollowed out section 48. Vent holes 32 are provided on the outer circumference of the cavity 30 that provide for communication between the cavity 30 and the outside of the second section 40.

In operation, the first and second sections (20 and 40) of the perforating gun connector 10 are first coupled to a first and second perforating gun (5 and 6) then connected to each other. It is preferred that this sequence of events be automated, such as with a pipe handling device or any other device that provides the automated ability to make up perforating guns to associated connectors. In more detail, the first step of the coupling process typically involves securing the sections (20 and 40) of the perforating gun connector 20 to the respective perforating guns (5 and 6). This can be accomplished in one of the manners described above, that is by using threads, dogs, latches, fastening devices, or any other now known or later developed attachment technique.

After each section (20 and 40) is attached to a perforating gun (5 and 6), the first section 20 can be secured to the second section 40. Securing the first section 20 to the second section 40 preferably employs the use of a pipe handling device. When a pipe handling device is used, the second perforating gun 6 with connected second section 40 is clutched by the pipe handling device and held such that the hollowed out section 48 is facing upwards. At substantially the same time, the first perforating gun 5 with connected first section 20 is also clutched by the pipe handling device. At this time, the perforating gun 5 with connected first section 20 should be oriented such that the bottom end 24 of the first section 20 is above the hollowed out section 48 and pointing downward. Furthermore, the bottom end 24 of the first section 20 should be substantially coaxial with the hollowed out section 48. The bottom end 24 and the hollowed out section 48 are then drawn towards each other and engaged and secured together. As is well known, in instances where threads (28 and 50) are provided on the bottom end 24 and the hollowed out section 48, the first section 20 is secured to the second section 40 by activating the pipe handling device to rotate either the first or second section (20 or 40) with respect to the other. When dogs or other latching devices are provided on the bottom end 24 and hollowed out section 48, the first section 20 can be secured to the second section 40 by setting down the first section 20 onto the second section 40 with some downward force or simply by the weight alone of the first section 20 and associated first perforating gun 5.

For the purposes of illustration the bottom end 24 has been described as being above the hollowed out section 48 prior to and during the engaging step of these two components. However, the relative elevation or orientation of the bottom end 24 with respect to the hollowed out section 48 prior to engagement is not important to the scope of the invention. These sections can be drawn together by moving both the bottom end 24 and the hollowed out section 48 at the same time, or by moving one towards the other. Furthermore, these two components could conceivably be drawn together while in the same elevational plane instead of one being above the other. In this embodiment of the invention, it is desired that the engaging sequence of the bottom end 24 and the hollowed out section 48 be conducted in an automated fashion and without the requirement for manual labor guiding the bottom end 24 into the hollowed out section 48.

One of the advantages of tapering the bottom end 24 of the first section 20 can be realized as the bottom end 24 engages the hollowed out section 48. Because the bottom end 24 is tapered, it can engage the hollowed out section 48 even when the axis of the first section 20 is not aligned with the axis of the second section 40. In instances when the axis of the first section 20 is not totally aligned to the axis of the second section 40 when attempting to couple the first section 20 to the second section, and yet the tip of the bottom end 24 is within the opening of the hollowed out section 48, the tapered shape of the bottom end 24 and the hollowed out section 48 will guide the first section 20 axis into alignment with the axis of the second section 40 as the bottom end 24 is inserted into the hollowed out section 48. One of the many advantages realized by this improved design is that the sections (20 and 40) of the perforating gun connector 10 can reliably be secured together by an automated device, such as a pipe handler. This improves the safety of this operation since personnel are not required to physically guide the sections together, but instead can remotely perform this operation by manipulating the pipe handling device.

Further, when the attachment means of the first and second section (20 and 40) comprises a threaded connection, the tapered configuration also greatly reduces the chances of cross threading, which increases reliability and assurance of proper attachment. Also, the implementation of tapered threads also enhances the ease and reliability of automated coupling the perforating gun connectors. Tapered threads, having a triangular shape with a crest at the top of the thread, are less likely to cross thread and also can provide a pressure seal, which some other threads cannot. Additional advantages of the present invention are that tapered threaded connections are self-sealing and self-locking. Thus a pressure seal can be realized at the perforation gun connection and the risk of the connections decoupling while in use can be eliminated.

Yet another advantage of the present invention is realized by the implementation of the upper and lower bulkheads (26 and 46). The presence of these bulkheads serves to protect the first booster charge 36 and the second booster charge 54 that reside within the perforating gun connector 10. Since these explosive charges are protected, as well as being hidden from view by the upper and lower bulkheads (26 and 46), an attendant is not necessary during the coupling process to protect against damage to these explosives, or to ensure they are in place.

A yet further advantage of the present invention is realized by the presence of the bulkheads in combination with the vent holes 32. In some prior art connectors that do not include bulkheads, it is possible that when the perforating gun is within the wellbore, the cavity 30 will be pressurized up to the pressure within the wellbore. After the perforating guns have fired, the cavity 30 is in pressure communication with the wellbore via the passages (34 and 52) and the apertures in the perforating guns (5 and 6) that are produced by detonating the shaped charges. This presents a problem when wellbore fluids clog the pressure paths connecting the cavity 30 to the wellbore and the pressure within the cavity 30 remains equal to wellbore pressure after the perforating guns (5 and 6) with perforating gun connector 10 have been removed from the wellbore. This can cause injury to personnel that attempt to disassemble the perforating gun assembly after the assembly has been removed from the wellbore. To alleviate this situation, the present invention includes vent holes 32 that provide for pressure equalization, thereby preventing pressurization of the cavity 30. An additional advantage obtained by implementing the bulkheads is realized when for some reason one of the perforating guns does not fire, the inside of associated section (20 or 40), as well as the inside body of the perforating gun, will not be exposed to wellbore fluids, this helps to conserve shaped charges and unfired perforating guns by preventing them from unnecessary exposure to well fluids.

One of the primary applications of the present invention involves insertion into a vertical wellbore. Therefore, the terms upper, lower, top, and bottom have been used for the purposes of convenience in order to aid in the description of the present invention. The scope of the present invention is not limited by these terms, but instead alternative embodiments of the present invention exist where an item having a designation as "lower" could in fact be above an item having an "upper" designation. For example, the scope of the present invention includes embodiments where the bottom end 24 is at an elevation greater than the elevation of the top end 22. Furthermore, it should be noted that these alternative embodiments apply to all elements described herein having an elevational term.

The present invention described herein, therefore, is well adapted to carry out the objects and attain the ends and advantages mentioned, as well as others inherent therein. While a presently preferred embodiment of the invention has been given for purposes of disclosure, numerous changes exist in the details of procedures for accomplishing the desired results. Such as, the tapered shape of the bottom end 24 and of the hollowed out section 48 can be triangular, hemispherical, or can have a portion of the taper that is not threaded. For example, the lower most section of the bottom end 24 could extend downward and not be threaded, but instead be used as a guide for insertion into the hollowed out section 48. These and other similar modifications will readily suggest themselves to those skilled in the art, and are intended to be encompassed within the spirit of the present invention disclosed herein and the scope of the appended claims.

What is claimed is:

1. A method of perforating a cased wellbore, the method comprising: inserting perforating guns having shaped charges into a wellbore, the perforating guns connected by a coupling, the coupling comprising:

a first section having an end threadingly engaged with a first perforating gun and an opposite end having a taper with male threads formed thereon, a second section, having an end with an opening, the opening having a taper corresponding to the first section tapered end, threads on the second section opening threadingly engaged with the first section tapered end, an opposite end threadingly engaged to a second perforating gun; and a cavity between the first and second sections and a vent extending between the cavity and the coupling outer surface, so that when the perforating gun is detonated, pressure within the coupling is equalized to the ambient pressure outside the coupling: perforating a portion of the wellbore by detonating the shaped charges.

2. The method of claim 1 further comprising, connecting the first section with the first perforating gun, connecting the second section with the second perforating gun, and coupling the first section to the second section using an automated pipe handling device.

* * * * *